US005942294A

United States Patent [19]

Heim

[11] Patent Number: 5,942,294

[45] Date of Patent: Aug. 24, 1999

[54] PREASSEMBLED TREE SIMULATION

[76] Inventor: Paul R. Heim, 1018 Del Rio Dr., Lady Lake, Fla. 32159

[21] Appl. No.: 08/977,801

[22] Filed: Nov. 25, 1997

[51] Int. Cl.[6] ..... A01N 3/00

[52] U.S. Cl. ..... 428/18; 428/19; 428/20

[58] Field of Search ..... 428/18, 19, 20

[56] References Cited

U.S. PATENT DOCUMENTS

| | | | |
|---|---|---|---|
| D. 218,689 | 9/1970 | Johnson, Jr. | D11/125 |
| D. 236,216 | 8/1975 | Fred | 428/18 X |
| D. 360,380 | 7/1995 | Eckhart | D11/118 |
| D. 363,685 | 10/1995 | Miller et al. | D11/118 |
| 3,704,366 | 11/1972 | Korb et al. | 428/18 X |
| 4,331,720 | 5/1982 | Vin Dick et al. | 428/20 X |
| 4,396,652 | 8/1983 | Koehler | 428/17 |
| 4,620,270 | 10/1986 | Laakso | 362/123 |
| 4,979,085 | 12/1990 | Voorhees | 362/252 |
| 5,094,893 | 3/1992 | Snider | 428/18 |
| 5,336,536 | 8/1994 | Oberzan | 428/20 X |

*Primary Examiner*—Timothy M. Speer
*Attorney, Agent, or Firm*—Edward M. Livingston, Esq.

[57] ABSTRACT

A preassembled tree simulation has decor strands (1) with top-simulation ends (2) attached to a roll-on member (9, 10, 11) onto which the decor strands are rolled for storage and from which the decor strands are unrolled to be suspended downwardly and outwardly from a raised attachment to an arrayer (12, 13, 14, 15, 16). Downward and outward suspension of the decor strands can be slanted, spiraled, curved or articulated selectively. The roll-on member can be a center rod, a telescopic rod, a positional rod, a tote handle or other convenient item. The arrayer can be a circular ring, a polygonal ring, a plurality of anchors, a single anchor, a resilient anchor rod, a segmental circular ring, a segmental polygonal ring, a segmental resilient rod or other convenient arrayer. The decor strands (1, 4, 5, 6, 7, 8, 29) can be Christmas-tree-light strands, cords, string, lines, ribbons, reflective lines, resilient rods of various shapes, helical spring lines, helical spring rods, helical spring ribbons or other types strands that support and/or communicate decoration.

32 Claims, 5 Drawing Sheets

FIG. 11
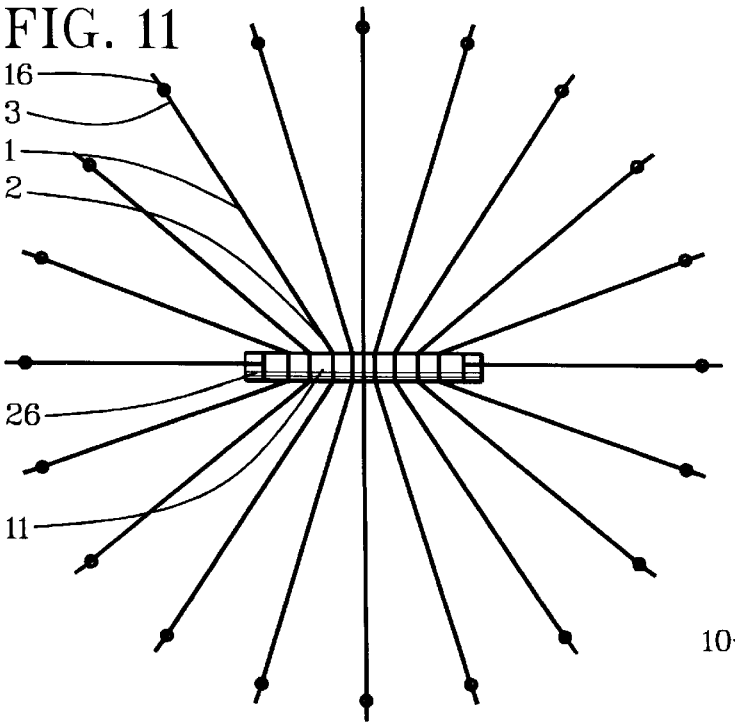
FIG. 12
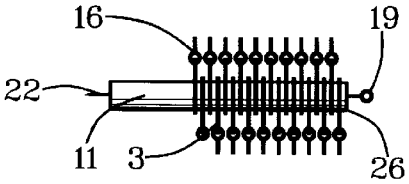
FIG. 13
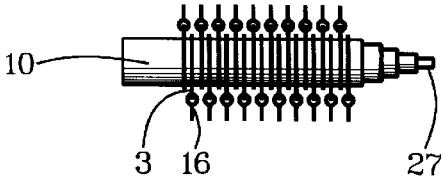
FIG. 14
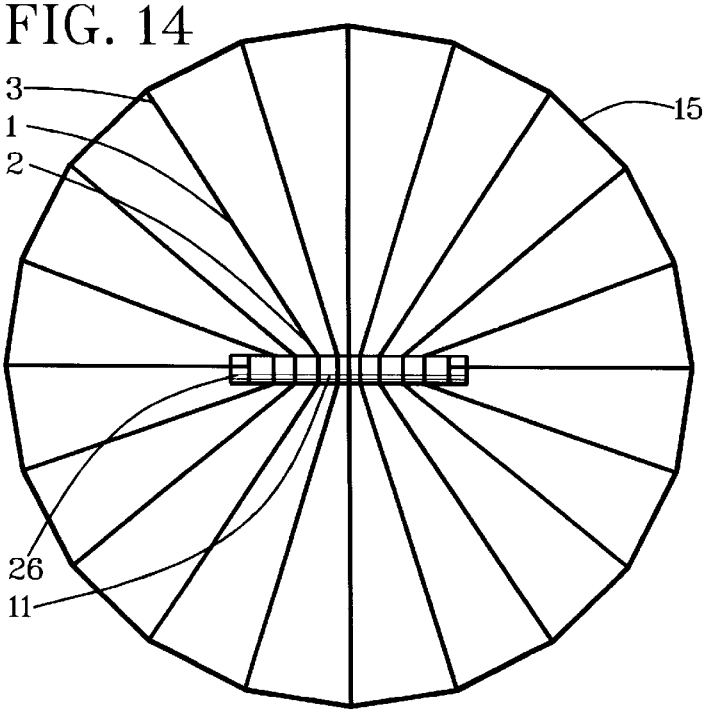
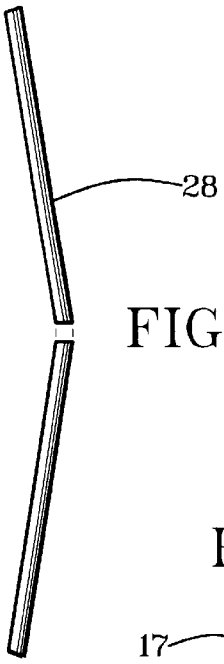
FIG. 15
FIG. 16
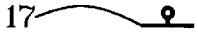

FIG. 17
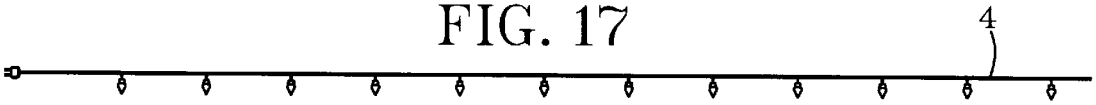
FIG. 18
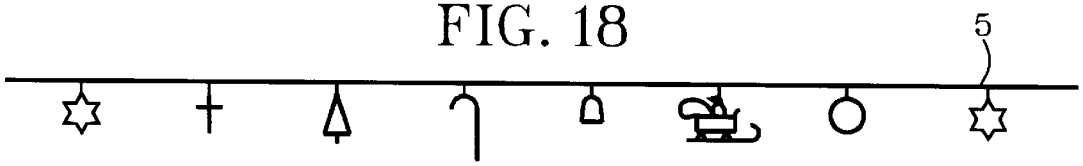
FIG. 19
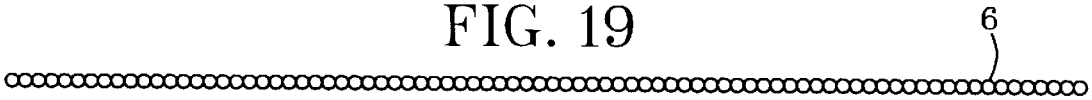
FIG. 20
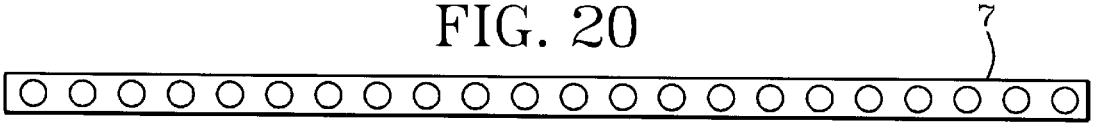
FIG. 21
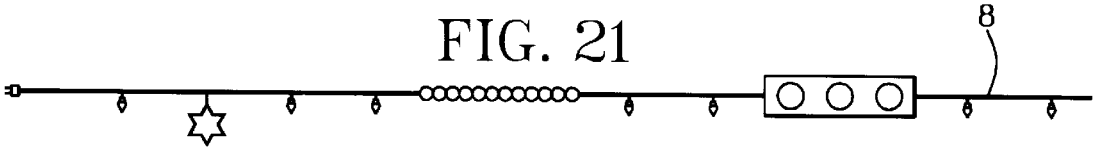
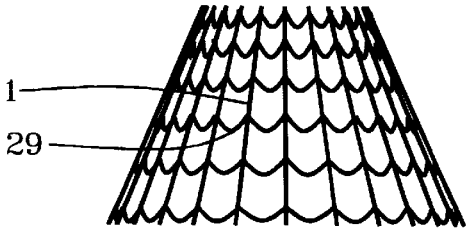
FIG. 22
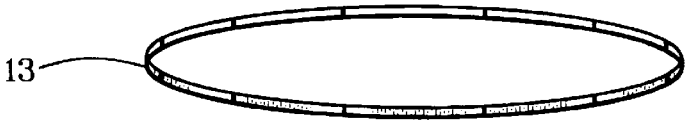
FIG. 23
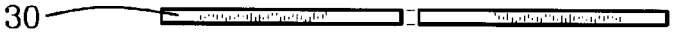
FIG. 24

PREASSEMBLED TREE SIMULATION

BACKGROUND OF THE INVENTION

This invention relates to artificial trees and in particular to artificial Christmas trees.

A wide variety of artificial Christmas trees and other types of artificial trees have been devised. None, however, are preassembled to be unrolled for being set up and rolled for being taken down and stored in manner taught by this invention.

Examples of different but related artificial Christmas trees are described in the following patent documents. U.S. Pat. No. 5,094,893, issued to Snider, described an artificial Christmas tree with a center pole, a polygonal hoop base and lines suspended from a top of the center pole to stakes positioned circumferentially about the center pole. U.S. Pat. No. 4,979,085, issued to Voorhees, described a light display apparatus with a truncate-cone shape for containing strands of light bulbs. U.S. Pat. No. 4,620,270, issued to Laakso, described a tree-lighting apparatus having a center pole around which a ring was positioned for a base of attachment of lines from a top of the center pole to the ring. U.S. Pat. No. 3,704,366, issued to Korb, et al., described a skeleton structure of tubular members extended outward radially from a bottom of a pole having a top from which lines were extended to outward ends of the tubular members.

SUMMARY OF THE INVENTION

In light of continuing public search for easy simulation of a lighted Christmas tree, objects of this invention are to provide a preassembled tree simulation which:

Can be unrolled for being set up and rolled up for being stored;

Can be packaged and marketed preassembled in small convenient packages;

Can be used in a wide variety of physical conditions such as on corners of houses, in wall corners, indoors and outdoors; and Is adaptable to a wide variety of decor.

This invention accomplishes these and other objectives with a preassembled tree simulation having decor strands with top-simulation ends attached to a roll-on member onto which the decor strands are rolled for storage and from which the decor strands are unrolled to be suspended downwardly and outwardly from a raised attachment to an arrayer. Downward and outward suspension of the decor strands can be slanted, spiraled, curved or articulated selectively. The roll-on member can be a center pole, a fastener, a tote handle or other convenience item. The arrayer can be a circular ring, a polygonal ring, a plurality of anchors, a single anchor, a resilient anchor rod, a segmental circular ring, a segmental polygonal ring, a segmental resilient rod or other convenient arrayer. The decor strands can be Christmas-tree-light strands, cords, string, lines, ribbons, reflective lines, resilient rods of various shapes, helical spring lines, helical spring rods, helical spring ribbons or other types strands that support and/or communicate decoration.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

This invention is described by appended claims in relation to description of a preferred embodiment with reference to the following drawings which are described briefly as follows:

FIG. 11 is a top view with a stake type of arrayer on decor strands suspended from a positional roll-on member;

FIG. 12 is a side view with a stake type of arrayer on decor strands rolled onto a positional roll-on member;

FIG. 13 is a side view with a stake type of arrayer on decor strands rolled onto a positional roll-on member;

FIG. 14 is a top view with a polygonal type of arrayer having decor strands rolled onto a positional roll-on member;

FIG. 15 is a top view of two adjacent joinable segments of a polygonal type of arrayer;

FIG. 16 is a side view of a floor-attachment type of arrayer;

FIG. 17 is a side view of a decor strand that is a string of decorative lights;

FIG. 18 is a side view of a decor strand that is a string of decorative items;

FIG. 19 is a side view of a decor strand that is a decorative string;

FIG. 20 is a side view of a decor strand that is a decorative ribbon;

FIG. 21 is a side view of a decor strand that is a combination of select decorative lines;

FIG. 22 is a side view of a section of decor strands that are attached to horizontally decorative members;

FIG. 23 is a perspective view of a segmented resilient ring arrayer; and

FIG. 24 is a side view of a straight resilient segment of the FIG. 23 ring arrayer.

DESCRIPTION OF PREFERRED EMBODIMENT

Figure 1:
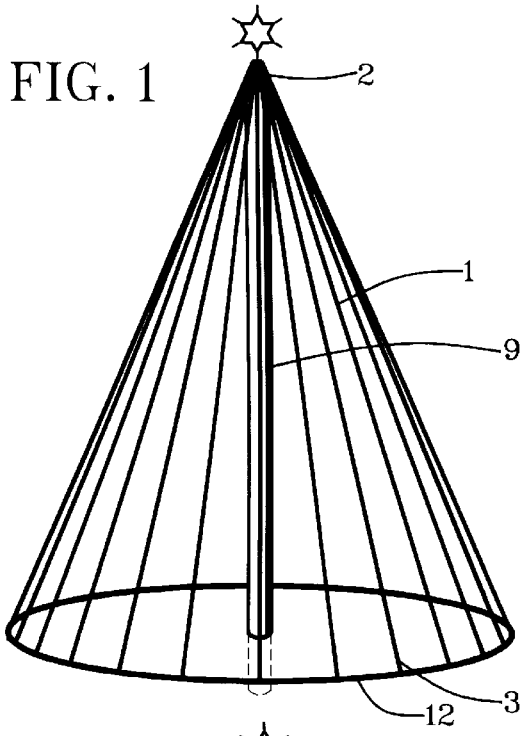
FIG. 1 is a side elevation view of an embodiment with a pole type of roll-on member.

For purposes of describing the preferred embodiment, the terminology used in reference to the numbered components in the drawings is as follows:

1. Decor strands

2. Top-simulation ends

3. Bottom simulation ends
4. Strings of decorative lights
5. Strings of decorative items
6. Decorative strings
7. Decorative ribbons
8. Strings of decor combinations
9. Rod
10. Telescopic rod
11. Positional roll-on member
12. Ring-bar arrayer
13. Segmented arrayer
14. Ribbon-ring arrayer
15. Polygonal arrayer
16. Spikes
17. Flat-surface fasteners
18. Top positioner
19. Fastener
20. Overhead member
21. Pillar
22. Bottom fastener
23. Wall
24. Segment ends
25. Rod top
26. Positioner top
27. Telescopic fastener end
28. Joinable segments
29. Horizontally decorative members
30. Thin-rod segments
31. Spiral Reference is made first to FIGS. 1–8 and 17–21. Decor strands 1 have top-simulation ends 2 and bottom-assimilation ends 3. The decor strands 1 can be such lines as are desired for generally decorative simulation of an outline of a tree such as a Christmas tree. Examples of typical decor strands 1 can include strings of decorative lights 4 depicted in FIG. 17, strings of decorative items 5 depicted in FIG. 18, decorative strings 6 depicted in FIG. 19, decorative ribbons 7 depicted in FIG. 20 and strings of select decor combinations 8 depicted in FIG. 21. Other types of decor strands 1 are foreseeable within the scope of this invention.

Figure 2:
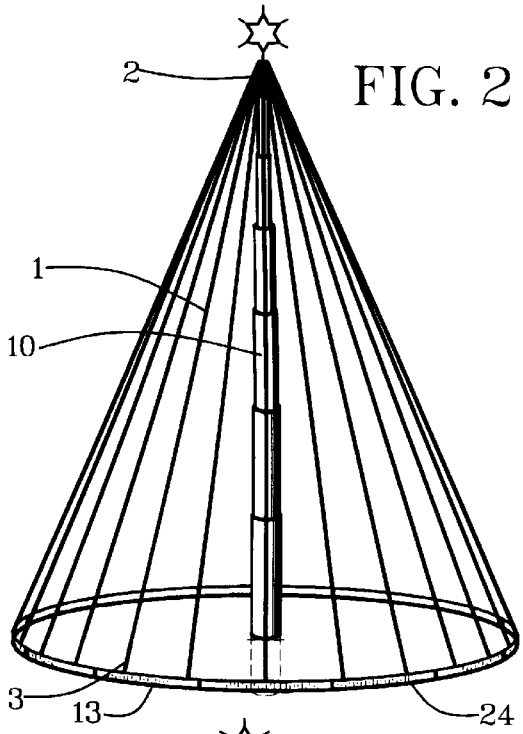
FIG. 2 is a side elevation view of an embodiment with a telescopic type of roll-on member.
Figure 3:
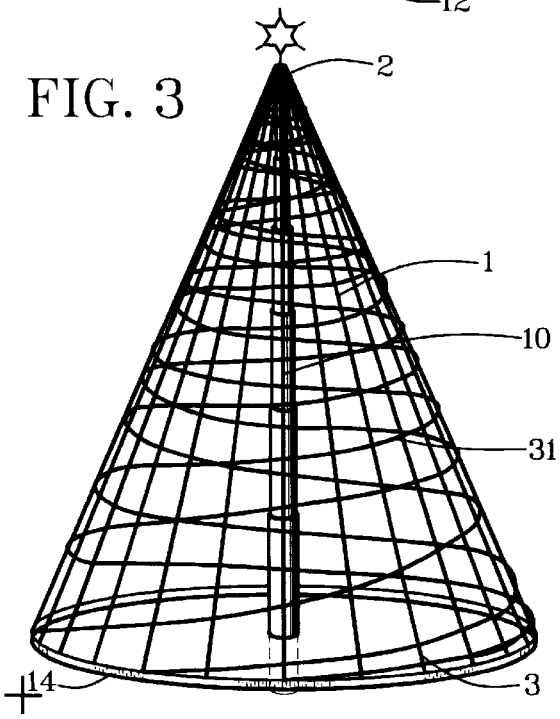
FIG. 3 is a side elevation view of an embodiment with a spiral decor stands.
Figure 4:
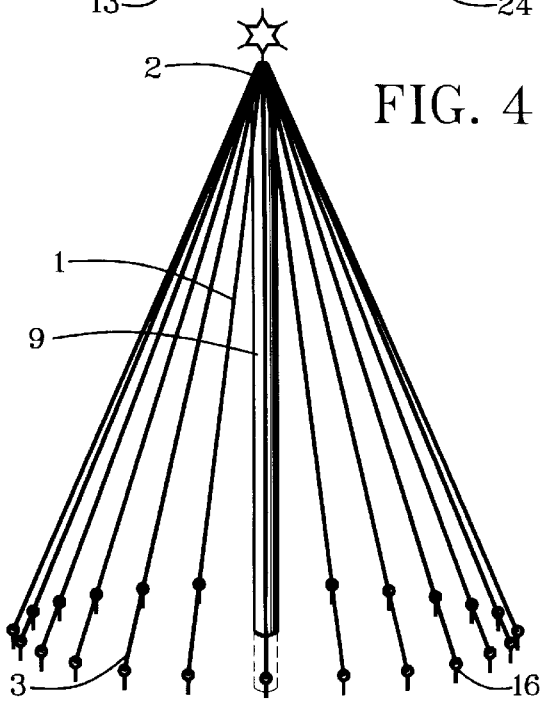
FIG. 4 is a side elevation view of an embodiment with a stake type of arrayer.
Figure 7:
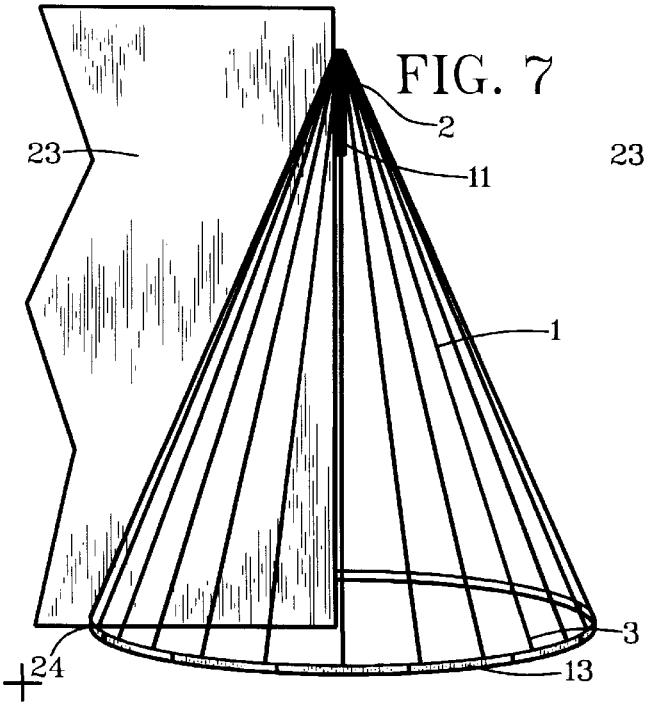
FIG. 7 is a side elevation view of an embodiment having a top support attached to an external wall corner and having a segmented arrayer positioned around the external wall corner.
Figure 8:
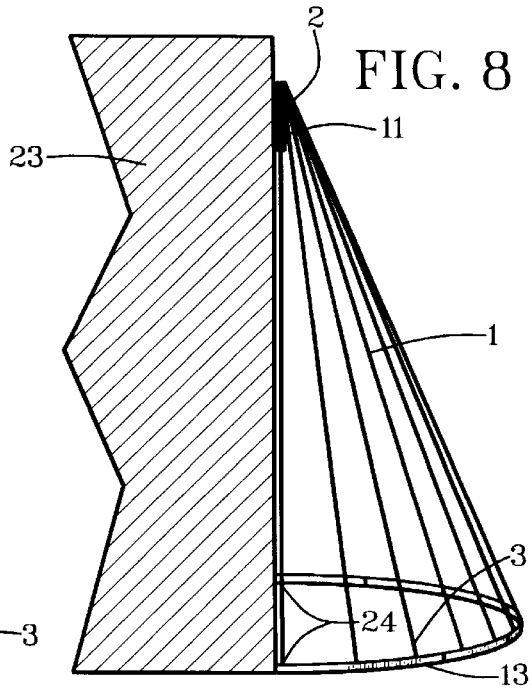
FIG. 8 is a side elevation view of an embodiment having a positional roll-on member supported by a straight wall and a segmented arrayer extended along a bottom of the straight wall.
Figure 9:
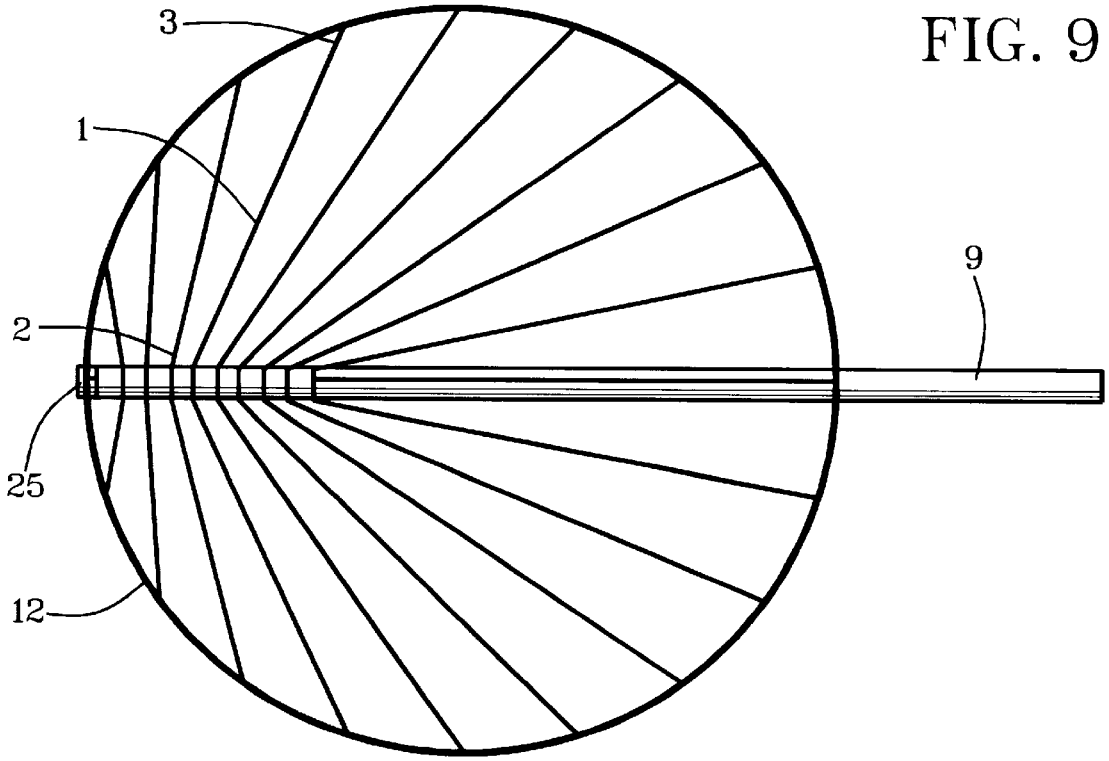
FIG. 9 is a top view with decor strands rolled onto a top portion of a pole type of roll-on member.

The top-simulation ends 2 are attached to roll-on members, such as, a rod 9 shown in FIGS. 1, 4 and 9; a telescopic rod 10 shown in FIGS. 2, 3 and 13; and a positional roll-on member 11 shown in FIGS. 5–8, 10, 11–12 and 14.

The bottom-simulation ends 3 are attached to arrayers such as a ring-bar arrayer 12 shown in FIGS. 1, 5, 9 and 10; a segmented arrayer 13 shown in FIGS. 2, 7, 8, and 23; a ribbon-ring arrayer 14 shown in FIG. 3; a polygonal arrayer 15 shown in FIG. 14; a plurality of fastener anchors such as spikes 16 shown in FIGS. 4, 6 and 11–13; or flat-surface fasteners 17 shown in FIG. 16.

The roll-on members, such as the rod 9 and the positional roll-on member 11, have axes about which the decor strands 1 are wound, spooled, wrapped or otherwise rolled for storage and from which the decor strands 1 are unwound, un-spooled, unwrapped or otherwise unrolled for convenient setup and use. The arrayers, such as the ring-bar arrayer 12, the segmented arrayer 13, the ribbon-ring arrayer 14, and the polygonal arrayer 15, have array-positioning structure with which the decor strands 1 are positioned in tree-simulation array without stringing, handling or otherwise positioning of separate decor strands 1 when unrolled from the roll-on members.

A roll-on member that is a rod 9 can have a length that extends to a solid surface for indoor or outdoor use as depicted by solid lines or that extends below a penetrable surface such as ground for outdoor use as depicted by dashed lines in FIGS. 1 and 4. A telescopic rod 10 can be extended selectively as shown by dashed lines in FIGS. 2–3 for extension to or below a surface.

Figure 5:
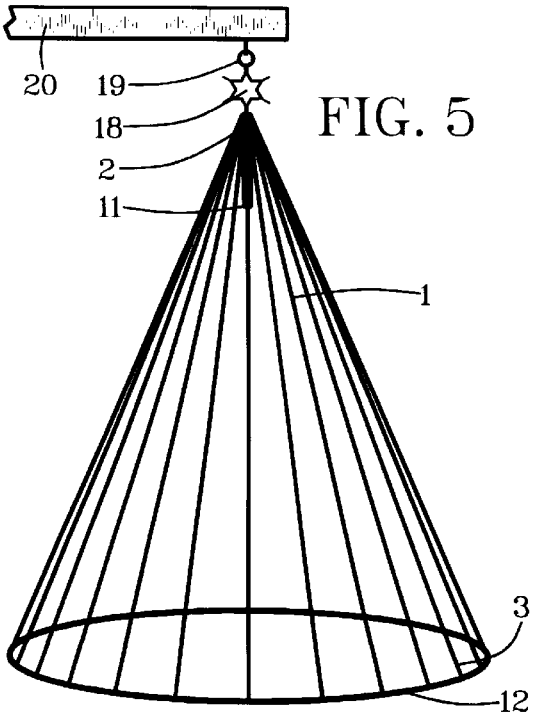
FIG. 5 is a side elevation view of an embodiment with a positional roll-on member having a fastener with which it is fastened to an overhead member.
Figure 6:
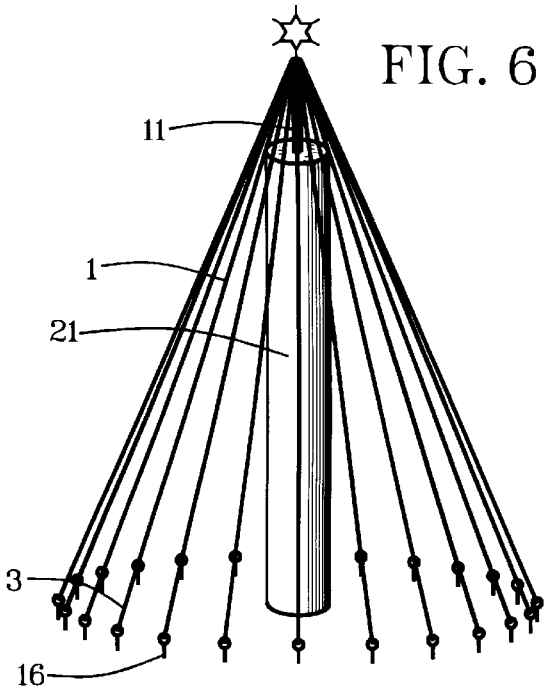
FIG. 6 is a side elevation view of an embodiment with a positional roll-on member supported internally by a separate object.

A top positioner 18 to which a positional roll-on member 11 is attached as shown on top of a tree simulation in FIG. 5 can be a decorative item such as a star on tops of tree simulations as shown in FIGS. 1–4 and 6. The top positioner 18 can have a fastener 19 with which the top positioner 18 is attached to an overhead member 20 to support the tree simulation from above the positional roll-on member 11. For supporting the positional roll-on member 11 from beneath on top of upright items such as a pillar 21 as shown in FIG. 6, the positional roll-on member 11 can have a bottom fastener 22 as shown in FIG. 12 or other fastener that is suitable for a particular upright item beneath the positional roll-on member 11.

A positional roll-on member 11 that is attached to a wall 23 as shown in FIGS. 7–8 can be attached with whatever type of fastener is appropriate for particular walls 23.

A segmented arrayer 13 can have segment ends 24 positioned against bottoms of walls 23 as shown in FIGS. 7–8 for positioning preassembled tree simulations around wall 23 corners, between wall 23 corners and along straight walls 23 of structures.

Referring to FIG. 9, decor strands 1 are wound around and onto a top portion of a roll-on member that is a rod 9 for storage although top-simulation ends 2 of the decor strands 1 are attached circumferentially to a rod top 25 of the rod 9.

Figure 10:
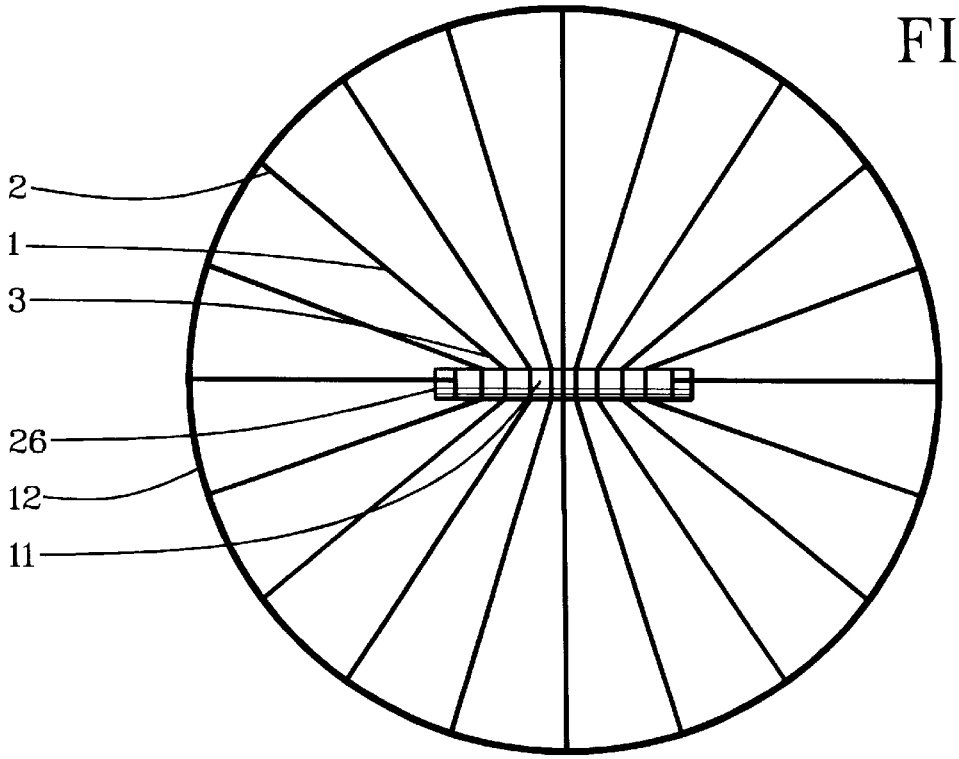
FIG. 10 is a top view with a ring type of arrayer with decor strands rolled onto a positional roll-on member.

Referring to FIGS. 10–12, decor strands 1 are wound around and onto a major portion of a relatively short positional roll-on member 11 for storage although top-simulation ends 2 of the decor strands 1 are attached circumferentially to a positioner top 26 of the positional roll-on member 11.

Referring to FIG. 13, a telescopic rod 10 can have a telescopic fastener end 27 to which top-simulation ends 2 are attached like that for rods 9 and 11. The decor strands 1 are wound around an outside periphery of a folded telescopic rod 10.

Referring to FIGS. 14–15, a polygonal arrayer 15 can have joinable segments 28 that are proximate a length of a positional roll-on member 11 with which it can be used optionally. This is a partial deviation from a preassembled objective but still has major features of the invention.

Referring to FIG. 22, the decor strands 1, which are generally flexible, can be attached to horizontally decorative members 29 to form a decorative network for simulation of branches or for a lacy decor.

Referring finally to FIGS. 23–24, a segmented arrayer 13 can be constructed of thin-rod segments 30 that are resiliently straight separately but can be curved circumferentially with ends of a plurality of the thin-rod segments 30 joined. This facilitates short packaging for marketing and pre-sale storage. After assembly for use, a ring arrayer formed by the thin-rod segments 30 can be left intact for preassembled reuse. Being resilient, the ring arrayer can be squeezed to an elliptical shape as shown in FIG. 23 in a perspective view for further ease of storage with bottom-simulation ends 3 of decor strands 1 attached and with either type of roll-on member 9, 10 or 11.

Referring further to FIGS. 3 and 17–21, the decor strands 1 can be suspended downwardly and outwardly from top-simulation ends 2 in slopes, straight lines and/or spirals 31 as shown in FIG. 3. Winding around the roll-on members 9–11 is the same helically whether with spirals 31 that are variously resilient or other decor strands 1 that are variously flexible.

A new and useful preassembled tree simulation having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. A preassembled tree simulation comprising:

decor strands having top-simulation ends and bottom-simulation ends;

a roll-on member to which the top-simulation ends are attached;

an arrayer to which the bottom-simulation ends are attached as arrayed selectively;

the roll-on member being structured for supporting the top-simulation ends of the decor strands in a selectively raised position; and the decor strands being rolled onto the roll-on member for storage and rolled from the roll-on member to be suspended downwardly and outwardly to the arrayer with the roll-on member being raised in an upright position and the arrayer being positioned vertically below a raised position of the top-simulation ends.

2. A preassembled tree simulation as described in claim 1 wherein:

the roll-on member is a rod having a top end and a bottom end.

3. A preassembled tree simulation as described in claim 2 wherein:

the bottom end of the rod extends to a position proximate bottom-simulation ends of the decor strands for positioning the bottom end of the rod on a surface on which the arrayer is positioned with the decor strands in an unrolled mode.

4. A preassembled tree simulation as described in claim 2 wherein:

the bottom end of the rod extends to a position below the bottom-simulation ends of the decor strands for positioning the bottom end of the rod below a surface on which the arrayer is positioned with the decor strands in an unrolled mode.

5. A preassembled tree simulation as described in claim 2 wherein:

the rod is a telescopic rod.

6. A preassembled tree simulation as described in claim 5 wherein:

the telescopic rod is extendible in relationship to lengths of the decor strands.

7. A preassembled tree simulation as described in claim 1 wherein:

the roll-on member is a positional roll-on member.

8. A preassembled tree simulation as described in claim 7 wherein:

the positional roll-on member has a top positioner that is structured to position the positional roll-on member on an object at a position vertically above the arrayer with the decor strands extended from the positional roll-on member to the arrayer with the decor strands in an unrolled mode.

9. A preassembled tree simulation as described in claim 8 wherein:

the top positioner is a decorative item.

10. A preassembled tree simulation as described in claim 1 wherein:

the roll-on member is topped with a decorative item.

11. A preassembled tree simulation as described in claim 1 wherein:

the decor strands are strings of decorative lights.

12. A preassembled tree simulation as described in claim 1 wherein:

the decor strands are strings of decorative items.

13. A preassembled tree simulation as described in claim 1 wherein:

the decor strands are decorative strings.

14. A preassembled tree simulation as described in claim 1 wherein:

the decor strands are decorative ribbons.

15. A preassembled tree simulation as described in claim 1 wherein:

the decor strands are strings of select combinations or decor.

16. A preassembled tree simulation as described in claim 1 wherein:

the decor strands are flexible lines.

17. A preassembled tree simulation as described in claim 1 wherein:

the decor strands are attached to horizontally decorative members.

18. A preassembled tree simulation as described in claim 17 wherein:

the decor strands and the horizontally decorative members are a decorative network.

19. A preassembled tree simulation as described in claim 1 wherein:

the decor strands are resilient coils having bottom-simulation ends spiraled outwardly and downwardly from top-simulation ends that are attached to the roll-on member.

20. A preassembled tree simulation as described in claim 1 wherein:

the arrayer is a ring having a diameter with a length proportional to a length of the decor strands to simulate general proportions and shape of a Christmas tree.

21. A preassembled tree simulation as described in claim 20 wherein:

the ring is resilient.

22. A preassembled tree simulation as described in claim 20 wherein:

the ring is joinable at ends of the ring to facilitate positioning of the ends together in a continuous periphery.

23. A preassembled tree simulation as described in claim 20 wherein:

the ring has ends that are separable and joinable for being positioned between corner walls, against walls and around corners of walls.

24. A preassembled tree simulation as described in claim 20 wherein:

the ring is segmented to facilitate short packaging and has segments that are joinable at ends to form arrayers having desired shapes.

25. A preassembled tree simulation as described in claim 24 wherein:

the segments are resilient members that are straight normally and can be curved to selectively arcuate and circular formations of arrayers in a joined mode.

26. The preassembled tree simulation of claim 25 wherein one or more of the segments serve as a roll-on member.

27. The preassembled tree simulation of claim 24 wherein the arrayer also serves as a roll-on member.

28. A preassembled tree simulation as described in claim 1 wherein:

the arrayer is a segmented polygon.

29. The preassembled tree simulation of claim 28 wherein the arrayer also serves as a roll-on member.

30. A preassembled tree simulation as described in claim 1 wherein:

the arrayer is a plurality of fastener anchors to which decor strands are attachable separately.

31. A preassembled tree simulation as described in claim 30 wherein:

the fastener anchors are spikes that can be driven into a ground surface for outdoor use.

32. A preassembled tree simulation as described in claim 30 wherein:

the fastener anchors are flat-surface fasteners.

* * * * *